US010214995B2

(12) United States Patent
McGlothen

(10) Patent No.: US 10,214,995 B2
(45) Date of Patent: Feb. 26, 2019

(54) MANIPULATING A DOWNHOLE ROTATIONAL DEVICE

(71) Applicant: Halliburton Energy Services, Inc., Houston, TX (US)

(72) Inventor: Jody Ray McGlothen, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 227 days.

(21) Appl. No.: 15/112,579

(22) PCT Filed: Dec. 30, 2014

(86) PCT No.: PCT/US2014/072726
§ 371 (c)(1),
(2) Date: Jul. 19, 2016

(87) PCT Pub. No.: WO2016/108835
PCT Pub. Date: Jul. 7, 2016

(65) Prior Publication Data

US 2016/0333666 A1 Nov. 17, 2016

(51) Int. Cl.
*E21B 34/14* (2006.01)
*E21B 34/12* (2006.01)
(Continued)

(52) U.S. Cl.
CPC ..... *E21B 34/14* (2013.01); *E21B 23/006* (2013.01); *E21B 33/1285* (2013.01); *E21B 34/12* (2013.01); *E21B 2034/007* (2013.01)

(58) Field of Classification Search
CPC . E21B 34/14; E21B 2034/007; E21B 33/1285
See application file for complete search history.

(56) References Cited

U.S. PATENT DOCUMENTS 5,226,483 A 7/1993 Williamson, Jr.
6,364,037 B1 * 4/2002 Brunnert ..... E21B 7/061 166/324

(Continued)

FOREIGN PATENT DOCUMENTS

WO 2011/146866 A2 11/2011

OTHER PUBLICATIONS

International Preliminary Report on Patentability issued in related Application No. PCT/US2014/072726, dated Jul. 13, 2017 (8 pages).

(Continued)

*Primary Examiner* — Catherine Loikith
(74) *Attorney, Agent, or Firm* — Scott Richardson; Baker Botts L.L.P.

(57) ABSTRACT

A system includes a valve housing with a port formed in a wall of the housing, a rotation sleeve disposed in the valve housing, an orienting sleeve with an orienting feature disposed in and fixed to the valve housing, and a shifter. The rotation sleeve is rotatable relative to the valve housing and includes a port formed therethrough. The shifter includes engagement features disposed a distance from each other along a length of the shifter and a rotational distance from each other about a circumference of the shifter. The engagement features are receivable into corresponding features of the orienting sleeve and the rotation sleeve to rotate the rotation sleeve relative to the valve housing as the shifter travels through the valve housing. The system may be used to selectively manipulate any number of valves in downhole equipment.

20 Claims, 7 Drawing Sheets

(51) Int. Cl.

| | |
|---|---|
| ***E21B 23/00*** | (2006.01) |
| ***E21B 33/128*** | (2006.01) |
| *E21B 34/00* | (2006.01) |

(56) References Cited

U.S. PATENT DOCUMENTS

| | | | | |
|---|---|---|---|---|
| 8,863,853 | B1 * | 10/2014 | Harris | E21B 23/004 166/318 |
| 2006/0124312 | A1 * | 6/2006 | Rytlewski | E21B 23/02 166/313 |
| 2009/0184278 | A1 | 7/2009 | Beall et al. | |
| 2013/0206402 | A1 | 8/2013 | Coon | |
| 2014/0048271 | A1 | 2/2014 | Coon et al. | |

OTHER PUBLICATIONS

International Search Report and Written Opinion issued in related PCT Application No. PCT/US2014/072726 dated Sep. 1, 2015, 12 pages.

* cited by examiner

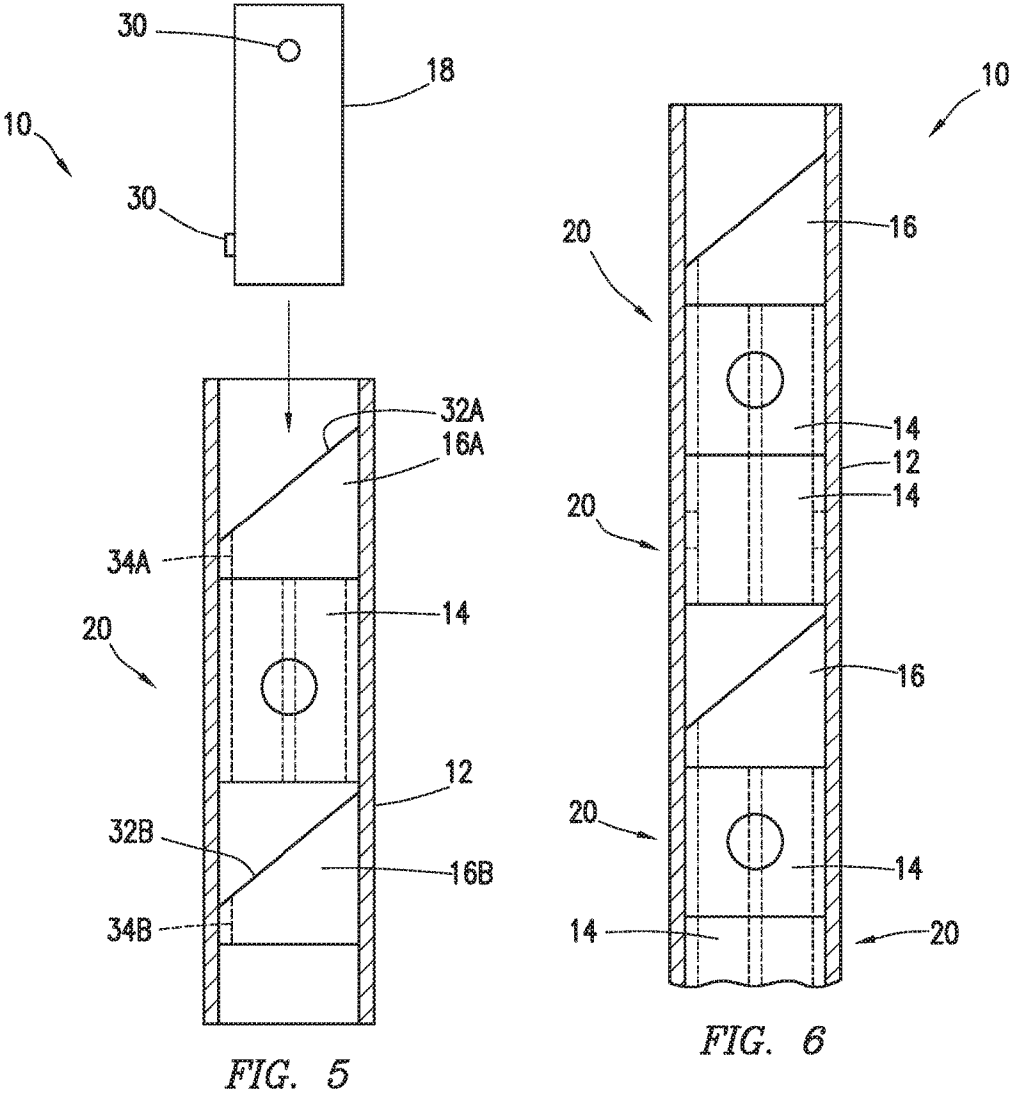
FIG. 5
FIG. 6
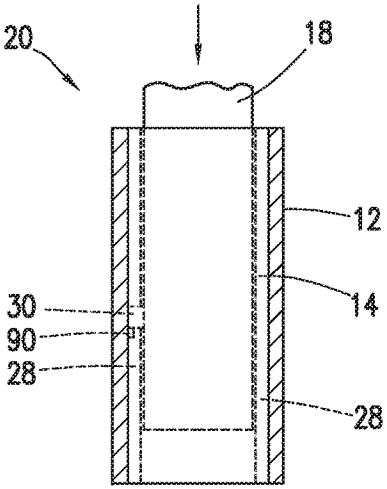
FIG. 7

MANIPULATING A DOWNHOLE ROTATIONAL DEVICE

CROSS-REFERENCE TO RELATED APPLICATION

The present application is a U.S. National Stage Application of International Application No. PCT/US2014/072726 filed Dec. 30, 2014, which is incorporated herein by reference in its entirety for all purposes.

TECHNICAL FIELD

The present disclosure relates generally to valves and other equipment used in oil and gas operations and, more particularly, to manipulating rotational sleeves to control downhole valves.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, or remedial activities. For example, temporary packers may be set in the wellbore during the completion and production operating phases of the wellbore. In addition, various operating tools including flow controllers (e.g., chokes, valves, etc.) and safety devices such as safety valves may be positioned in the wellbore. Such downhole equipment may be selectively actuated in a number of different ways. For example, it is common practice to manipulate certain valves open or closed by dropping a ball into a flowpath through the downhole equipment. The ball is designed to catch on an interior sleeve of the downhole equipment, and additional pressure is applied behind the ball to force the sleeve downward, thereby opening or sealing the valve. Unfortunately, dropped balls rely on a variation in inner diameter of the tool string, thereby limiting the number of valves that can be manipulated along a tool as well as the number of times a valve can be selectively opened and closed in this manner.

In other instances, pressurized fluid from the surface may be pumped downhole to actuate various downhole tools, such as a packer setting tool. These setting tools often include a chamber held at atmospheric pressure and having a rupture valve. The pressurized fluid pumped downhole can then rupture the valve, and the pressure differential from the ruptured valve forces a piston to set the packer. Unfortunately, providing this high pressurization from the surface can burden downhole equipment.

BRIEF DESCRIPTION OF THE DRAWINGS

For a more complete understanding of the present disclosure and its features and advantages, reference is now made to the following description, taken in conjunction with the accompanying drawings, in which:

FIG. 5 is a schematic cross sectional view of a rotational valve assembly having two orienting sleeves, in accordance with an embodiment of the present disclosure;

FIG. 6 is a schematic cross sectional view of a rotational valve assembly having multiple valves and orienting sleeves, in accordance with an embodiment of the present disclosure;

FIG. 7 is a schematic cross sectional view of a rotational valve having a stopper mechanism to stop actuation of the valve, in accordance with an embodiment of the present disclosure;

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for actuating rotational valves and other downhole tools via a linear actuation mechanism. The system may utilize a linear mechanical shifter that is dropped downhole to selectively actuate a rotational valve into an open or closed position. Any desirable number of rotational valves may be disposed along a tool string and actuated via the linear mechanical shifter. These rotational valves may be opened or closed based on where the valves are located along the length of the tubing, not based on an inner diameter of the valve sleeves. That is, the system may include any desirable number of sleeves (e.g., fracturing sleeves) having approximately the same inner diameter and that can be manipulated selectively based on the length of the linear mechanical shifter. This set up may increase the flexibility of downhole valve actuation, allowing a greater number of valves to be manipulated and for valves to be selectively opened and closed multiple times.

The linearly actuated rotational valve system may be utilized in several different contexts. For example, a rotational valve may be actuated in this method to actuate and/or set either a conventional or hydrostatic packer. In addition, a rotational valve system having multiple valves may be used in fracturing operations in order to selectively open and close valves within different fracturing zones of a wellbore. Further, the rotational valve may be used as a relatively inexpensive adjustable flow sub to provide a desired amount of flow out of the valve.

Figure 1:
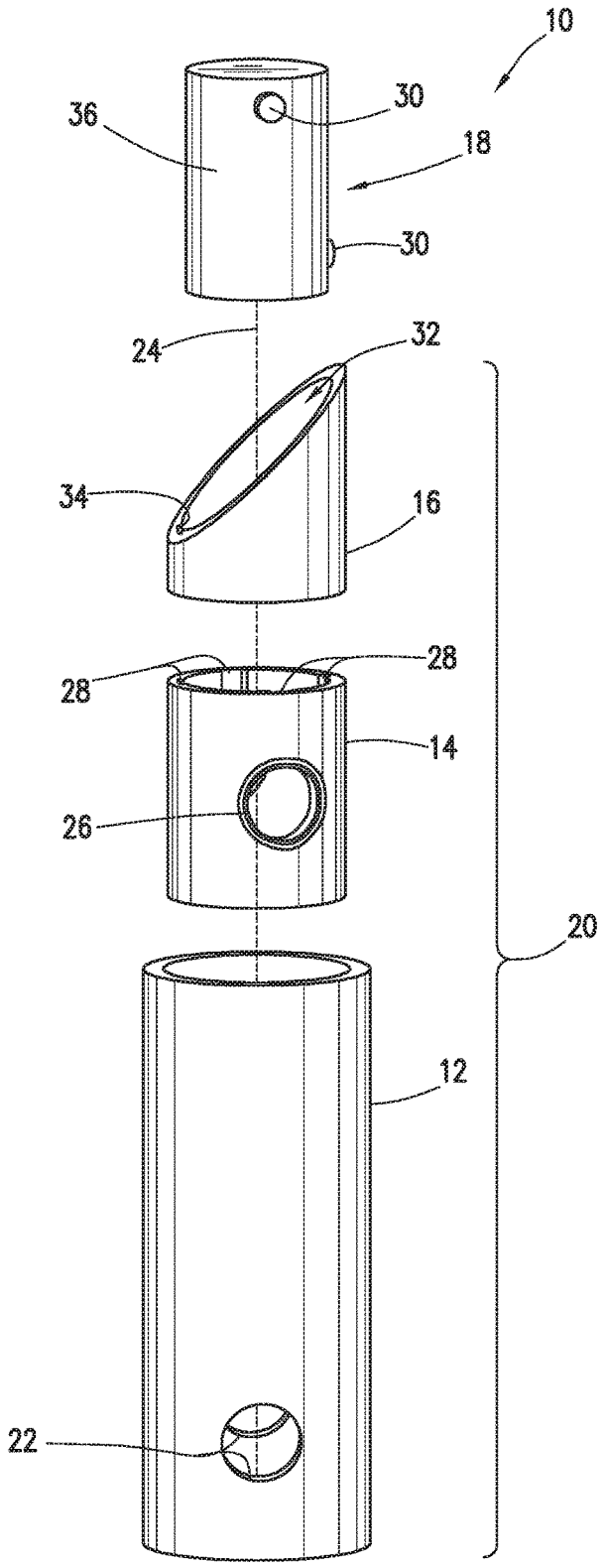
FIG. 1 is an exploded perspective view of a rotational valve assembly, in accordance with an embodiment of the present disclosure.

Turning now to the drawings, an embodiment of the linearly actuated rotational valve system 10 is illustrated in an exploded view in FIG. 1. The system 10 may include a valve housing 12, a rotation sleeve 14, an orienting sleeve 16, and a shifter 18. The valve housing 12, rotation sleeve 14, and orienting sleeve 16 may function together as a valve 20, and the shifter 18 may be used to change a state of the valve 20. For example, as the shifter 18 moves through the valve 20, the shifter 18 may transition the valve 20 between an open state and a closed state. In some embodiments, the shifter 18 may transition the valve 20 between a range of different open states to provide a desired flow of fluid through the valve 20.

As illustrated, the valve housing 12 may include ports 22 formed along a wall of the valve housing 12. In the illustrated embodiment, for example, the valve housing 12 includes two ports 22 that are oriented 180 degrees from each other about an axis 24 of the valve 20. It should be noted that other numbers and relative arrangements of ports 22 may be formed in the valve housing 12 in other embodiments.

As illustrated, the rotation sleeve 14 may also include ports 26 formed therein. The rotation sleeve 14 may be disposed in the valve housing 12 and rotatable relative to the valve housing 12, in order to selectively bring the ports 26 of the rotation sleeve 14 into alignment with the ports 22 of the valve housing 12. In some embodiments, the ports 26 of the rotation sleeve 14 may be surrounded by O-rings designed to seal the ports 26 of the rotation sleeve 14 inside the valve housing 12. Although illustrated as having two ports 26 separated by 180 degrees around a circumference of the rotation sleeve 14, there may be any desirable number or relative arrangement of ports 26 formed in the rotation sleeve 14 in other embodiments. The rotation sleeve 14 may also include features designed to engage certain features present on the shifter 18. In the illustrated embodiment, for example, the rotation sleeve 14 may include four axially aligned (e.g., parallel to the axis 24) broached slots 28 formed along an inner diameter of the rotation sleeve 14. These slots 28 may be designed to receive lugs 30 or other projections from the shifter 18, thus allowing passage of the shifter 18 therethrough.

The orienting sleeve 16 may include an orientation feature such as an angled top 32, as illustrated. As described in detail below, the angled top 32 (or some other orientation feature) may aid in the rotation of the shifter 18 and the rotation sleeve 14 relative to the valve housing 12. The orienting sleeve 16 may also include one or more features used to engage the features (e.g., lugs 30) present on the shifter 18. For example, in the illustrated embodiment, the orienting sleeve 16 may include an axially aligned broached slot 34 formed along an inner diameter of the orienting sleeve 16. The broached slot 34 may be formed at a circumferential position along the orienting sleeve 16 that corresponds with the lowest side of the orienting sleeve 16 or lowest part of the angled top 32. The orienting sleeve 16 may be disposed in the valve housing 12 and fixed to the inside of the valve housing 12. This may prevent rotation of the orienting sleeve 16 relative to the valve housing 12 while enabling rotation of the rotation sleeve 14 relative to the valve housing 12. The orienting sleeve 16 may be disposed at a position adjacent the rotation sleeve 14 within the valve housing 12, and the orienting sleeve 16 and the rotation sleeve 14 may each have approximately the same inner diameter.

The shifter 18 may include a substantially cylindrical body 36 and two lugs 30 extending or projecting radially outward from the body 36. Although lugs 30 are illustrated, other types of engagement features may be used in other embodiments to engage corresponding features along the inner diameter of the rotation sleeve 14 and the orienting sleeve 16. As illustrated, the lugs 30 may be disposed a specific linear distance from each other along the axial length of the shifter 18, as well as at a specific rotational distance from each other along a circumference of the shifter 18. This offset of the lugs 30 in both the lengthwise and rotational directions may be used to convert linear movement of the shifter 18 through the valve 20 into rotation of the rotation sleeve 14 relative to the valve housing 12. In some embodiments, the shifter 18 may be made from any desirable material including, but not limited to, metal, thermoplastic polymer, dissolvable materials, and so forth.

Figure 2:
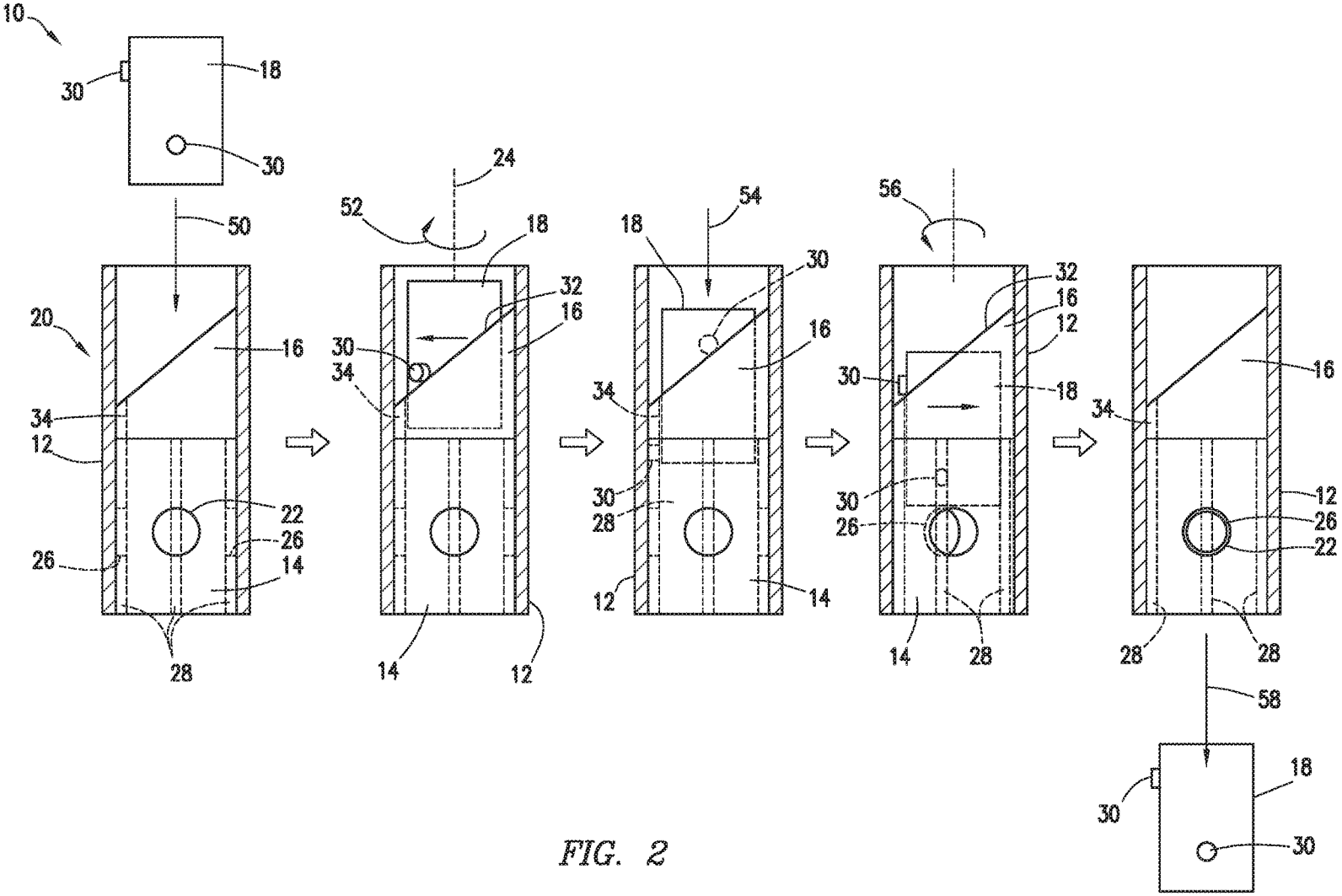
FIG. 2 is a schematic view of a rotational valve being actuated by a linear mechanical shifter, in accordance with an embodiment of the present disclosure.

FIG. 2 schematically illustrates the linearly actuated rotational valve system 10 in operation. As illustrated, the shifter 18 may first be received into the valve 20. To that end, the shifter 18 may be dropped into a wellbore. The valve 20 may be positioned along the wellbore and, therefore, able to receive the shifter 18. It should be noted that the disclosed system including the shifter 18 and valve 20 may be used in an open wellbore or in a cased wellbore. In addition, the system may be used or deployed in a tubing string, a casing string, a liner, or a tool string disposed in the wellbore.

In the illustrated embodiment, the valve 20 is fully assembled. As illustrated, the orienting sleeve 16 may be assembled above the rotation sleeve 14 inside the housing 12. In other embodiments, however, the orienting sleeve 16 may be assembled below the rotation sleeve 14 inside the housing 12. In the illustrated assembly, the rotation sleeve 14 is oriented such that the slot 34 of the orienting sleeve 16 is aligned with one of the slots 28 of the rotation sleeve 14. The valve 20 may initially be configured in a closed position. For example, as illustrated, the rotation sleeve 14 is oriented relative to the valve housing 12 such that the ports 26 through the rotation sleeve 14 are not aligned with the ports 22 formed through the valve housing 12. In other instances, however, the rotation sleeve 14 may be positioned so that the ports 22 and 26 are aligned and the valve 20 is initially opened.

When it is time to manipulate the valve 20 (e.g., from closed to open), the shifter 18 may be run or pumped into the well. More specifically, the shifter 18 may be pumped down via pressurized fluid through a string of tubing or a tool string positioned in the wellbore. In other embodiments, the shifter 18 may be run into the wellbore via a conveying mechanism (e.g., wireline, slickline, coiled tubing, etc.). As the shifter 18 is lowered through the well, the valve 20 may receive the shifter 18 from above, as illustrated by arrow 50 in FIG. 2.

As the shifter 18 enters the valve 20, the lower lug 30 on the shifter 18 may then contact the angled top 32 of the orienting sleeve 16. As the shifter 18 continues to move downward from this position, the angled top 32 may direct the shifter 18 to rotate about the axis 24, as illustrated by arrow 52. This rotation generally brings the lower lug 30 of the shifter 18 toward the lower side of the angled top 32, such that the lug 30 may be aligned with the slot 34. As illustrated, this rotation may occur in a clockwise direction about the axis 24. In other embodiments, the rotation may be in a counterclockwise direction, depending on which side of the orienting sleeve the lug 30 was initially positioned.

Once the shifter 18 is rotated such that the lower lug 30 is oriented with the slot 34 through the orienting sleeve 16, the lug 30 may enter the slot 34 and allow the shifter 18 to pass through the orienting sleeve 16. Once past the orienting sleeve 16, the lower lug 30 may continue to drop into the aligned slot 28 of the rotation sleeve 14. As illustrated by arrow 54, the shifter 18 may continue to linearly drop through the valve 20 until the upper lug 30 of the shifter 18 contacts the angled top 32 of the orienting sleeve 16.

The top lug 30 on the shifter 18 may contact the angled face 32 of the orienting sleeve 16, which may again turn the shifter 18 as illustrated by arrow 56. This rotation may be in a counterclockwise direction about the axis 24, as illustrated, or in a clockwise direction depending on the rotational offset of the two lugs 30 from one another on the shifter 18. As with the lower lug, this rotation generally brings the upper lug 30 of the shifter 18 toward the lower side of the angled top 32, such that the lug 30 may be aligned with the slot 34.

As the shifter 18 rotates in this manner, the bottom lug 30 disposed in the slot 28 through the rotation sleeve 14 may cause the rotation sleeve 14 to rotate a predefined distance relative to the valve housing 12. This predefined distance generally corresponds to the rotational offset between the two lugs 30. That is, the lugs 30 in the illustrated embodiment may be approximately 90 degrees offset from one another about the circumference of the shifter 18. This may result in a 90 degree rotation of the rotation sleeve 14 as the upper lug 30 moves toward the slot 34 in the orienting sleeve 16. By rotating the rotation sleeve 14, the shifter 18 may bring the ports 26 of the rotation sleeve 14 into alignment with the ports 22 formed in the valve housing 12, thereby opening the valve 20. A similar process may be used to move the valve 20 from the open position back to a closed position using another shifter 18.

Once the shifter 18 rotates enough to align the upper lug 30 with the slot 34 through the orienting sleeve 16, the lug 30 may enter the slot 34 and allow the shifter 18 to pass through the orienting sleeve 16. Once past the orienting sleeve 16, the upper lug 30 may continue to drop into the aligned slot 28 of the rotation sleeve 14. Thus, the shifter 18 may continue to linearly drop through the valve 20 until the shifter 18 exits the bottom of the valve 20, as shown by arrow 58. Once the shifter 18 exits the valve 20, the shifter 18 may continue to drop through other downhole tools, tubing, or directly into an open wellbore. In some embodiments, the same shifter 18 may travel through multiple valves 20 positioned along a tool string, thereby coordinating their operation or change in state along the length of the tool string.

In some embodiments, the shifter 18 may be constructed from a material that is dissolvable in downhole fluids. For example, and without limitation, the shifter 18 may be at least partially constructed from aluminum, copper, zinc, magnesium, or water-soluble plastic materials that are reactive with certain fluids. After the shifter 18 is released into a lower portion of a tubing string or the wellbore, certain downhole fluids may be pumped toward the shifter 18 to aid in dissolving the shifter 18. In other embodiments, the shifter 18 may dissolve in the fluids that are already present downhole. Thus, the shifter 18 may be dropped into the wellbore with little or no impact on the environment, space constraints, or structure of the bottom of the wellbore and without having to later be retrieved. This may also allow for multiple shifters 18 to be dropped down a single tubular string to manipulate valves 20 disposed along the string.

Figure 3:
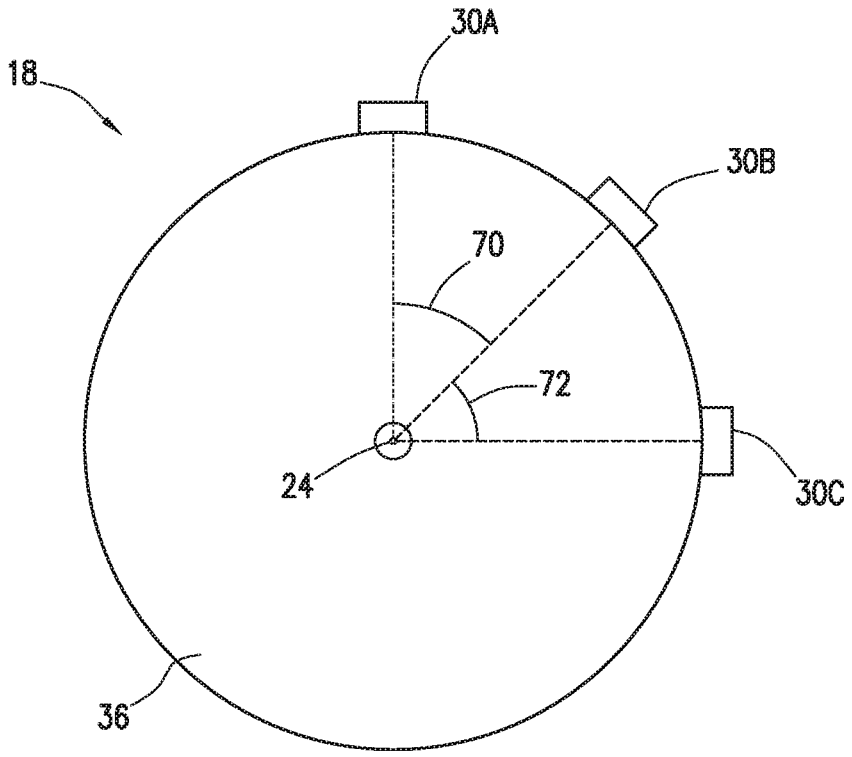
FIG. 3 is an above view of a linear mechanical shifter with three projections, in accordance with an embodiment of the present disclosure.

The linearly actuated rotational valve system 10 illustrated in FIGS. 1 and 2 may represent a relatively simplified embodiment of the valve system 10. Other embodiments may include, for example, shifters 18 that actuate multiple different valves 20. FIG. 3 is an above view of a more complex shifter 18 that may be used in the disclosed system 10. The shifter 18, as illustrated, may include at least three lugs 30A, 30B, and 30C positioned at certain angles from each other. That is, the lugs 30A and 30B are rotationally offset from one another by an angle 70 about the axis 24 of the system 10, while the lugs 30B and 30C are rotationally offset from one another by an angle 72 about the axis 24. These angles 70 and 72 may be the same or different. As described above, each of these lugs 30A, 30B, and 30C may also be linearly offset from one another along the length of the body 36 of the shifter 18 in a direction of the axis 24. It should be noted that, in other embodiments, two or more of the lugs 30 disposed on the shifter 18 may be aligned rotationally with each other while a third is rotationally offset from them.

Figure 4:
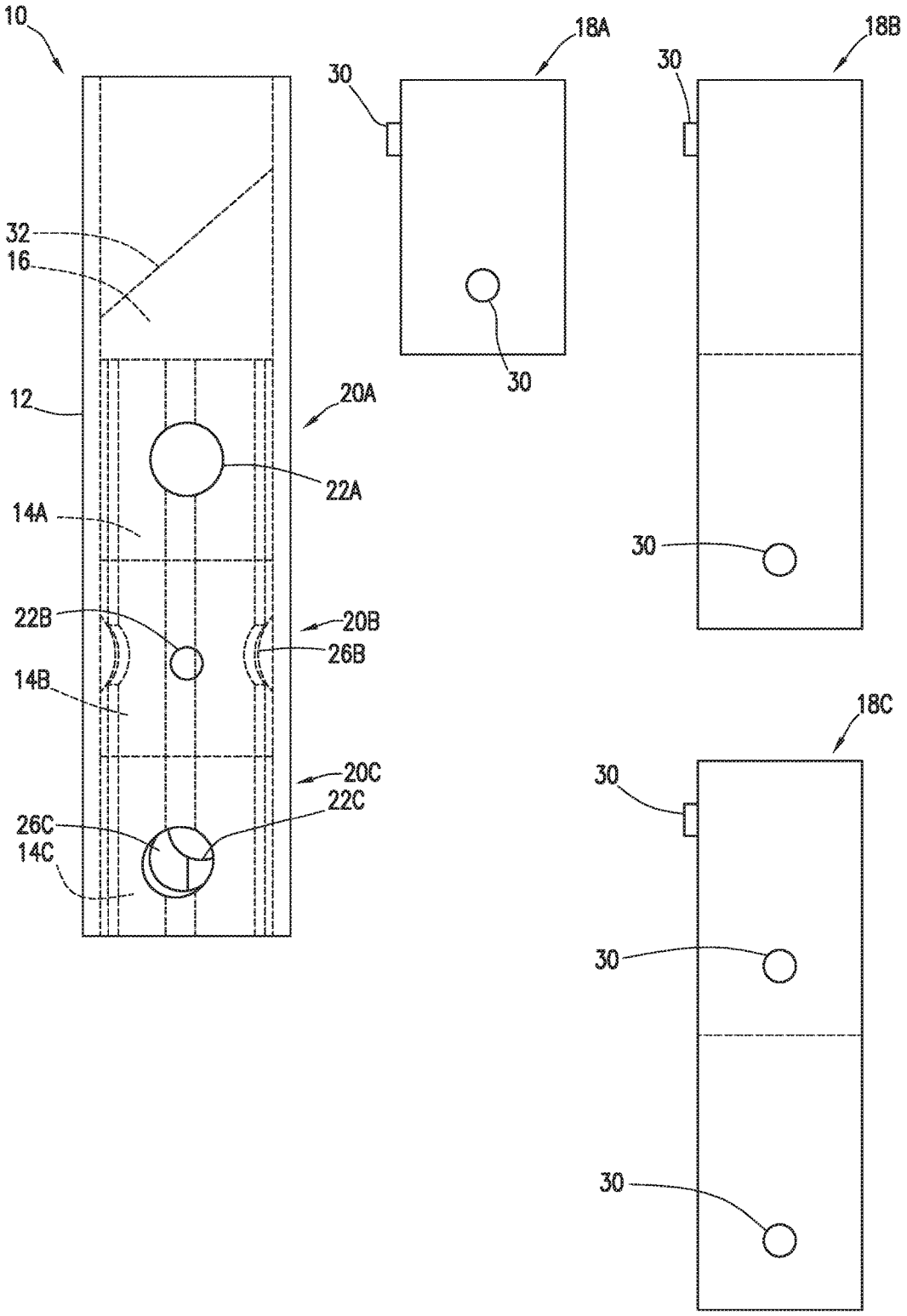
FIG. 4 is a schematic view of a series of rotational valves and multiple linear mechanical shifters that may be used to actuate the valves, in accordance with an embodiment of the present disclosure.

FIG. 4 illustrates another relatively complex embodiment of the linearly actuated rotational valve system 10. In this embodiment, the valve system 10 includes three valves 20A, 20B, and 20C that may be selectively actuated via one or more shifters 18. Specifically, in the illustrated embodiment, the system 10 also includes three shifters 18A, 18B, and 18C that may selectively change a state of operation of one or more of the stacked valves 20A, 20B, and 20C. It should be noted that any desirable combinations of different valves 20 and shifters 18 may be utilized in other embodiments to provide the appropriate valve control for a downhole tool.

In the illustrated embodiment, the valve system 10 may include the valves 20A, 20B, and 20C formed via the valve housing 12, the orienting sleeve 16, and three corresponding rotation sleeves 14A, 14B, and 14C. Ports are formed on the corresponding rotation sleeves 14 and may be rotated with respect to three sets of ports 22A, 22B, and 22C formed into the valve housing 12 to enable the selective opening (ports aligned) or closing (ports not aligned) of the valves 20A, 20B, and 20C. While only ports 26B and 26C on rotation sleeves 14B and 14C are illustrated, it will be understood that rotation sleeve 14A has its own port, which is not visible in the present drawing.

As illustrated, the valve 20A may be initially closed, the valve 20B may also be initially closed, and the valve 20C may be initially opened. However, it should be understood that any desirable starting configuration of the ports 22 and 26 relative to one another may be utilized. In the illustrated embodiment, the ports 22A, 22B, and 22C on the valve housing 12 may not all be aligned with each other about the circumference of the valve housing 12. This may enable the valve system 10 to provide flow paths in many different directions through the downhole equipment.

The different shifters 18A, 18B, and 18C may facilitate different actuations of the valves 20 present in the system 10. For example, the shifter 18A may be used to change a state of only the first valve 20A. This is because the length of the shifter 18A only reaches from the angled top 32 of the orienting sleeve 16 to the first rotation sleeve 14A. Once the shifter 18A travels down the orienting sleeve 16 while rotating the rotation sleeve 14A, the shifter 18A may continue to travel directly through the other rotation sleeves 14B and 14C in a linear fashion via the slots formed therein. Thus, the shifter 18A may be used to selectively open the closed valve 20A without affecting the other valves 20B and 20C.

The shifter 18B may be used to change a state of only the second valve 20B. This is because the length of the shifter 18B between the top and bottom lugs 30 reaches from the angled top 32 of the orienting sleeve 16 to the second rotation sleeve 14B. That is, the bottom lug 30 may have already passed through the first rotation sleeve 14A via the slots formed therein at the time the top lug 30 contacts the orienting sleeve 16. The top lug 30 of the shifter 18B may then travel down the orienting sleeve 16, rotating the rotation sleeve 14B to open the valve 20B. After rotating the rotation sleeve 14B in this manner, the shifter 18B may continue to travel directly through the remaining rotation sleeve 14C in a linear fashion via the slots formed therein. Thus, the shifter 18B may be used to selectively open the closed valve 20B without affecting the other valves 20A and 20C.

A shifter similar to the shifters 18A and 18B may be used to rotate only the third valve 20C while maintaining the other valves 20A and 20B in their current positions. This type of shifter 18 (not shown) may include two lugs positioned a linear distance apart that corresponds to the linear distance between the orienting sleeve 16 and the corresponding valve 20C.

As in the illustrated embodiment, a shifter 18 having a length that corresponds to a length between the orienting sleeve 16 and a given rotation sleeve 14 may be used to selectively control just the desired rotation sleeve 14. In the illustrated embodiment, the valve system 10 includes a single orienting sleeve 16 used with a plurality of stacked rotation sleeves 14 to form different valves 20. However, in other embodiments, each of the valves 20 present may include their own orienting sleeve 16. In such instances, the length of the different rotation sleeves 14 may be varied so that a shifter 18 matching the length of any given rotation sleeve 14 may be utilized to actuate only that rotation sleeve 14.

Another shifter 18C is illustrated in FIG. 4. This shifter 18C may include three lugs 30 and may be used to actuate both the first and second valves 20A and 20B at the same time. The bottom two lugs 30 of the shifter 18C may each pass through the orienting sleeve 16 via the slot formed therein, and the bottom lug 30 may pass through the first rotation sleeve 14A before the top lug 30 contacts the orienting sleeve 16. The top lug 30 of the shifter 18C may then travel down the orienting sleeve 16, rotating the rotation sleeves 14A and 14B to open the valves 20A and 20B. After rotating the rotation sleeves 14A and 14B in this manner, the shifter 18C may continue to travel directly through the remaining rotation sleeve 14C in a linear fashion via the slots formed therein. Thus, the shifter 18C may be used to selectively open the closed valves 20A and 20B at the same time, without affecting the third valve 20C.

Other embodiments of the shifter 18 may be used to change a state of more than one valve 20 at a time. For instance, the shifter 18 may, in some embodiments, include three lugs 30 that are all rotationally offset from each other about the circumference of the shifter 18. In such instances, the shifter 18 may first function to rotate the first rotation sleeve 14A via the lower lug 30 engaging with the rotation sleeve 14A while the middle lug 30 engages with the orienting sleeve 16. Then, the shifter 18 may rotate the first rotation sleeve 14A again via the middle lug 30 engaging with the rotation sleeve 14A and rotate the second rotation sleeve 14B via the lower lug 30 engaging with the rotation sleeve 14B while the top lug 30 engages with the orienting sleeve. Again, several other arrangements of the shifter 18 may be utilized in other embodiments to provide the desired valve control, and an appropriate shifter 18 may be selected for use depending on the desired valve control for the downhole application.

The disclosed valve system 10 may be used to manipulate several different valves 20 disposed along a tubing string, compared to existing systems that utilize other methods for selectively manipulating a valve. Specifically, the disclosed system 10 utilizes a series of orienting sleeves 16 and rotation sleeves 14 that include approximately the same inner diameters. Existing valve actuation techniques involve dropping balls or using other tools that engage a sleeve having a certain inner diameter to actuate a particular valve. Thus, the control of such valves typically relies on differences in inner diameter. Since the diameter of the tool string is limited, the amount of valves that can be controlled in this manner is limited. However, in the disclosed embodiments, the valve control relies on an axial length of the rotating sleeves 14 relative to the orienting sleeves 16 or relative to other rotating sleeves. Thus, the disclosed valve control may be applied several times along the length of the tubing string without exhausting the available space and without changing the inner diameter of the valves 20.

As shown in FIG. 5, other embodiments of the linearly actuated rotational valve system 10 may include a first orienting sleeve 16A (having orienting slot 34A) disposed above a valve 20 and a second orienting sleeve 16B disposed below the valve 20. The orienting sleeve 16B below the valve 20 may be designed to change a state of the valve 20 shortly after the valve 20 has been shifted via the shifter 18 engaging with the above orienting sleeve 16A. For example, the illustrated shifter 18 may first be received into the valve 20 as shown. The lower lug 30 may engage with the rotation sleeve 14 as the top lug 30 approaches the angled top 32A of the upper orienting sleeve 16A. Movement of the top lug 30 along the angled top 32A may encourage rotation of the rotation sleeve 14 to change the state of the valve 20 (e.g., from open to closed). After this rotation, the upper lug 30 may fall into engagement with the rotation sleeve 14 while the lower lug 30 drops toward the angled top 32B of the orienting sleeve 16B. At this point, the lower lug 30 may no longer be oriented with the slot 34B in the orienting sleeve 16B. Accordingly, the lower lug 30 may move along the angled top 32B to encourage rotation of the rotation sleeve 14 to change the state of the valve 20 again (e.g., from closed to open). Thus, the configuration of the valve 20 with two orienting sleeves 16 adjacent the rotation sleeve 14 may enable a relatively quick open/closed valve reversing function using a single shifter 18.

In some embodiments, it may be desirable to actuate a downhole valve by raising a lug 30 through the valve 20 (from bottom to top). Although not shown, some embodiments of the linearly actuated rotational valve system 10 may accomplish this using a lower orienting sleeve 16 disposed below the valve 20 and having an angled bottom face (i.e., orienting feature). The angled bottom face may be used to actuate the valve 20 as a lug 30 is raised through valve 20 from bottom to top via a wireline, slickline, coiled tubing, or some other conveying member. In such systems, the orienting sleeve 16 may be disposed directly adjacent the bottom of the valve 20 and having a slanted lower face extending downward from the valve 20, as basically an upside down version of the illustrated orienting sleeve 16A. This orientation may enable the same lug 30 to initiate and later reverse an operation of the valve 20 while the lug 30 is disposed downhole. For example, the lug 30 may be lowered on coiled tubing and passed through the valve 20 with an orienting sleeve 16 on top to rotate the valve into an open position. At some later time, the lug 30 may then be raised via the coiled tubing so that it passes through the valve 20 with the oppositely oriented sleeve on the bottom to rotate the valve back into a closed position. Other arrangements of these components may be utilized in other embodiments to selectively alter an operational state of the valve 20.

Other embodiments of the valve system 10 may include any desirable number, arrangement, and combination of rotation sleeves 14 and orienting sleeves 16 to perform the desired valve manipulation. For example, FIG. 6 illustrates an embodiment of the system 10 that includes at least four valves 20 that may be selectively actuated via shifters (not shown) engaging with two orienting sleeves 16 and four rotation sleeves 14. As discussed in detail above, different types and lengths of shifters may be dropped into the illustrated series of valves 20 to selectively manipulate the desired valves 20.

In some embodiments, it may be desirable to temporarily halt the actuation of one or more valves 20 during the process of changing the state of the valves 20. FIG. 7 illustrates an embodiment of a valve 20 having a stopper 90 to perform this function. More specifically, the valve 20 may include the stopper 90 (e.g., shear pin stopper) disposed in the rotation sleeve 14 in order to stop the manipulation of the valve 20 at a halfway point. The stopper 90 may be disposed in one or more of the slots 28 formed through the rotation sleeve 14. In other embodiments, the stopper 90 may be positioned along the angled top of the orienting sleeve.

As the shifter 18 is lowered through the illustrated rotation sleeve 14, the shifter 18 may rotate the rotation sleeve 14 via the bottom lug 30 engaged with the slot 28 while an upper lug (not shown) travels along an angled top of the orienting sleeve. As the lug 30 moves downward through the slot 28 in the rotation sleeve 14, the lug 30 may catch on the stopper 90. The stopper 90 may stop the lug 30 traveling through the rotation sleeve 14 and, consequently, stop rotation of the rotation sleeve 14. After a certain amount of time, or once a certain action is performed, an operator may pressurize the tubing string, thereby increasing the pressure on the top of the shifter 18. Once the pressure reaches a certain threshold, the shifter 18 may shear the stopper 90 and finish actuating the valve 20 before dropping out of the valve 20.

In some embodiments, the stopper 90, the rotation sleeve 14, the valve housing 12, and the shifter 18 may be configured to allow for the valve 20 to be opened or closed for a limited amount of time. For example, these components may be designed so that a complete actuation of the valve 20 via the shifter 18 takes the valve 20 from a closed position, into an open position at the point where the stopper 90 stops the shifter 18, and back into a closed position as the shifter 18 drops out. In other embodiments, the shifter 18 may take the valve 20 from an open position, into a closed position at the point where the stopper 90 stops the shifter 18, and back into an open position as the shifter 18 drops out. That way, an operator may be able to control how long a particular valve 20 is opened or closed in order to perform a desired function before shearing the stopper 90 and returning the valve 20 to its original state.

Figure 8:
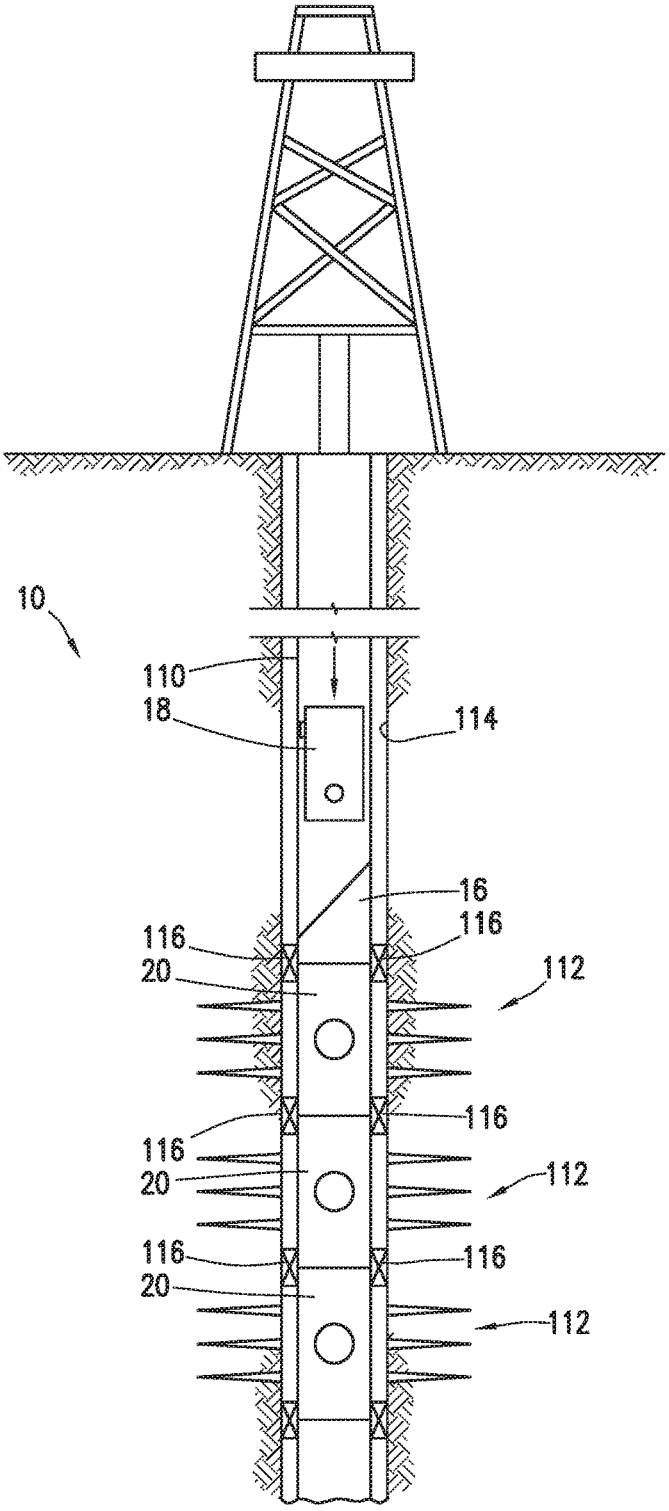
FIG. 8 is a schematic cross sectional view of a rotational valve assembly being used to selectively open valves at particular fracturing zones of a wellbore, in accordance with an embodiment of the present disclosure.

The disclosed valve system 10 may be utilized in several different contexts related to oil and gas production. For example, FIG. 8 illustrates an embodiment of the system 10 being utilized on a production tubing string 110 to selectively open and close the production tubing string 110 to different fracturing zones 112 along a wellbore 114. Each of the fracturing zones 112 may be separated from other zones of the wellbore 114 via packers 116 positioned between the production tubing string 110 and the wellbore 114. The above described valves 20 may be positioned within each of the fracturing zones 112, enabling the system 10 to selectively open or close various fracturing zones 112 relative to the production tubing string 110.

It may be desirable to selectively drop the shifter 18 through the production tubing 110, where the shifter 18 may then actuate one of the valves 20 to an open or closed state at a time. This may enable a controllable sequence for opening a fracturing zone 112, fracturing the wellbore 114 in the zone 112, closing the fracturing zone 112, and moving on to another zone. The particular valves 20 may be selectively opened or closed by using shifters 18 of different lengths, as described in detail above. In some embodiments, the shifter 18 may be designed with three lugs in order to selectively close one valve 20 while opening another valve 20, thereby saving time while moving from one fracturing zone 112 to the next.

In some embodiments, as illustrated, the shifter 18 may be untethered. The term "untethered" may refer to the shifter 18 not being otherwise coupled to any tool string, coiled tubing, slickline, wireline, or the like. Instead, the untethered shifter 18 may be dropped through or moved through the wellbore 114 (and the one or more valves 20) via gravity, fluid pressure applied against the shifter 18, or a combination thereof. That is, the untethered shifter 18 may move through the wellbore 114 or valve 20 without any direct physical or mechanical connection between the shifter 18 and an upstream or downstream device that drives or moves the shifter 18. Existing fracturing systems typically utilize a dropped ball or some other method that differentiates fracturing zone valves based on their relative inner diameter. As a result, these existing systems generally only allow for a limited number of steps (and fracturing zones) before the inner diameter becomes an unusable differentiation method. As described above, the disclosed system 10 utilizes length to segregate the valves that are placed along the different fracturing zones 112. This may extend the number of zones 112 that may be selectively accessed and fractured, as compared to existing systems. In addition, since the disclosed system 10 utilizes mechanical actuation and control logic, it may be lower cost and more reliable than more complicated electronic control methods. It should be noted that the valve system 10 may be applied to other types of valves 20 as well, such as index equalizing valves used to close off the wellbore 114 from below a packer 116 to above the packer 116.

Figure 9:
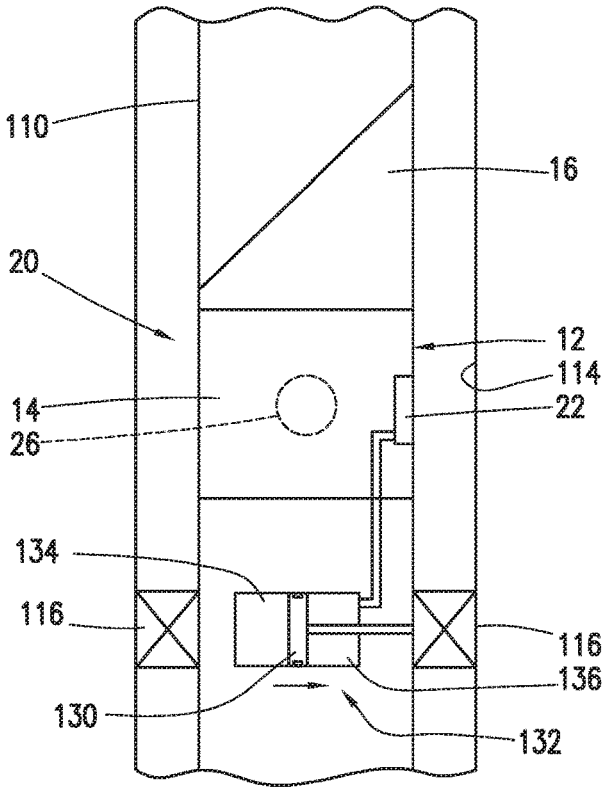
FIG. 9 is a schematic view of a rotational valve assembly being used to set a packer, in accordance with an embodiment of the present disclosure.

In other embodiments, the valve system 10 may be used to actuate a packer setting tool. An example of one such packer setting tool embodiment is illustrated in FIG. 9. In the illustrated embodiment, the valve 20 is used to isolate an atmospheric chamber on a hydrostatic set packer 116, and the packer 116 may be set by pumping the shifter (not shown) through the production tubing 110 and the valve 20. To that end, the packer setting system may include a piston 130 disposed in a chamber 132 that is initially filled with fluid at atmospheric pressure on both sides 134 and 136 of the piston 130. When the shifter is dropped, it may open the valve 20 by rotating the rotation sleeve 14 so that the port 26 of the rotation sleeve 14 aligns with the port 22 of the valve housing 12. One side 136 of the chamber 132 may be fluidly coupled to the valve 20 via a flowline 138. When the valve 20 is opened, this may open the side 136 of the piston 130 to hydrostatic pressure, which may actuate the piston 130 to pressurize and set the packer 116 (arrow 140). Once the packer 116 is set, the valve 20 may be closed, keeping one side 134 of the piston 130 filled with fluid to maintain the packer 116 in a set position.

In still further embodiments, the valve system 10 may be used to provide intelligent completions in certain wells. That is, the above described valve system 10 may be used to selectively control a desired flow rate of fluid through the valve 20, in order to provide the desired amount of flow of completion fluids from the production tubing into a specific zone of the wellbore, or vice versa with production fluids. For example, in a large open hole section of a wellbore, several zones may be isolated by packers, and it may be desirable to shut off or pinch back certain zones to regulate the flow of fluids.

Figure 10:
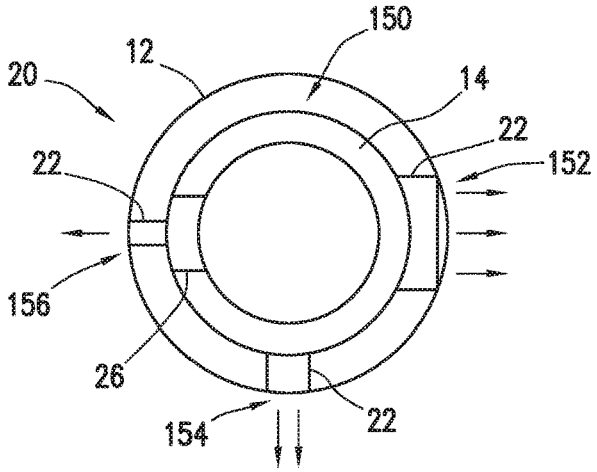
FIG. 10 is an above view of a rotational valve assembly that may be used for intelligent completions, in accordance with an embodiment of the present disclosure.

One embodiment of the valve 20 allowing such intelligent completions is illustrated in FIG. 10. The illustrated valve 20 includes four different settings, although other valves may include fewer or more settings. In some embodiments, the valve 20 may include the valve housing 12 having ports 22 increasing in size at every 90 degrees, and a single port 26 through the rotation sleeve 14, as illustrated. In other embodiments, the valve 20 may include the valve housing 12 having a single port 22 disposed therein and the rotation sleeve 14 having ports 26 increasing in size at every 90 degrees. In this manner, the degrees of rotation that may be used to provide the desired flow rate is a function of exit hole diameter through the valve 20. The valve 20 may have multiple states of performance. For example, the shifter may rotate the rotation sleeve 14 by 90 degrees for each pass so that the valve 20 has four active states. These active states may include, for example, closed 150, fully opened 152, partially opened 154, and limited flow 156. In some embodiments, the valve 20 may include an active state that acts as a one-way flow with a check valve. It should be noted that other active flow states may be features in other embodiments. By using the above disclosed valve system 10 to change the state of the valve 20 between different active states, it may be possible to selectively control a state of valves 20 disposed along a production flowline as desired throughout the life of the well, without the use of control lines going to the surface.

Embodiments disclosed herein include:

A. A system including a valve housing including a port formed in a wall of the valve housing, a rotation sleeve disposed in the valve housing, an orienting sleeve disposed in and fixed to the valve housing at a position adjacent the rotation sleeve, and a shifter including at least two engagement features formed on an outer diameter of the shifter. The rotation sleeve is rotatable relative to the valve housing and includes a port formed therethrough, and the orienting sleeve includes an orienting feature. The engagement features are disposed a distance from each other along a length of the shifter and a rotational distance from each other along a circumference of the shifter. The engagement features are receivable into corresponding features of the orienting sleeve and corresponding features of the rotation sleeve to rotate the rotation sleeve relative to the valve housing as the shifter travels through the valve housing.

B. A system includes a shifter for selectively changing a state of a valve of a downhole tool. The shifter includes a body and at least two engagement features formed into the body. The engagement features are disposed at an axial distance from each other along a length of the body and at a rotational distance from each other along a circumference of the body. The engagement features are receivable into corresponding features of an orienting sleeve and a rotation sleeve of the valve to rotate the rotation sleeve relative to a valve housing of the valve as the shifter travels through the valve.

C. A method includes receiving a shifter into a first end of a valve. The method also includes lowering and rotating the shifter relative to the valve. A state of the valve is changed as the shifter passes through the valve and exits a second end of the valve opposite the first end.

Each of the embodiments A, B, and C may have one or more of the following additional elements in combination: Element 1: wherein the engagement features of the shifter include lugs projecting outward from the shifter, and wherein the corresponding features of the orienting sleeve and of the rotation sleeve include axially aligned slots formed in the orienting sleeve and the rotating sleeve. Element 2: wherein the orienting sleeve is disposed above the rotation sleeve. Element 3: further including a plurality of rotation sleeves disposed adjacent one another in series along a length of the valve housing. Element 4: further including a plurality of shifters including engagement features for engaging one or more of the plurality of rotation sleeves. Element 5: further including a stop mechanism disposed along one or more of the corresponding features of the orienting sleeve and of the rotating sleeve to stop the shifter from traveling through the valve housing. Element 6: further including a plurality of orienting sleeves disposed at different axial positions along a length of the valve housing. Element 7: further including a packer setting device, the packer setting device including a piston disposed in an atmospheric chamber and a flowline disposed from the atmospheric chamber on one side of the piston to the port in the valve housing. Movement of the piston sets a packer and, when the port of the rotation sleeve aligns with the port in the valve housing, a pressure difference in the atmospheric chamber pushes the piston to set the packer. Element 8: wherein the valve housing, the orienting sleeve, and the rotation sleeve form a valve, and wherein the shifter selectively opens the valve by bringing the port of the rotation sleeve into alignment with the port of the valve housing. Element 9: wherein one or both of the orienting sleeve and the rotation sleeve includes multiple ports formed therein and having different relative sizes.

Element 10: wherein the shifter further includes at least three engagement features formed into the body. Element 11: wherein the at least two engagement features are disposed at a rotational distance of approximately 90 degrees from each other along the circumference. Element 12: wherein the shifter is dissolvable in downhole fluids.

Element 13: further including rotating a rotation sleeve of the valve relative to a valve housing of the valve to change the state of the valve based on a change in alignment between a port formed in the valve housing and a port formed in the rotation sleeve. Element 14: further including dissolving the shifter in a downhole fluid after changing the state of the valve. Element 15: further including setting a packer by changing the state of the valve. Element 16: further including receiving the shifter through multiple valves disposed in series along a length of a tool string, and changing a state of at least one of the multiple valves based on an axial length of the shifter. Element 17: further including changing a state of more than one of the multiple valves at the same time via the shifter. Element 18: wherein the shifter includes at least two engagement features formed on an outer diameter of the shifter and wherein the valve includes a rotation sleeve and an orienting sleeve disposed in a valve housing. Element 19: further including receiving a first engagement feature of the shifter into a corresponding feature of the rotation sleeve. Element 20: further including lowering and rotating the shifter relative to the valve housing via a second engagement feature of the shifter moving along a slanted top of the orienting sleeve. Element 21: wherein the shifter is an untethered shifter.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a valve housing comprising a port formed in a wall of the valve housing;

a rotation sleeve disposed in the valve housing, wherein the rotation sleeve is rotatable relative to the valve housing and comprises a port formed therethrough, and wherein the rotation sleeve comprises a rotation feature;

an orienting sleeve disposed in and fixed to the valve housing at a position adjacent the rotation sleeve, wherein the orienting sleeve comprises an orienting feature; and a shifter comprising a substantially cylindrical body and at least two lugs projecting radially outward from the body in fixed relation to each other and to the cylindrical body, the lugs being disposed a distance from each other along a length of the body and a rotational distance from each other along a circumference of the body;

wherein the lugs are receivable into corresponding features of the orienting sleeve and corresponding features of the rotation sleeve to rotate the rotation sleeve relative to the valve housing as the shifter travels through the valve housing.

2. The system of claim 1, wherein the corresponding features of the orienting sleeve and of the rotation sleeve comprise axially aligned slots formed in the orienting sleeve and the rotating sleeve.

3. The system of claim 1, wherein the orienting sleeve is disposed above the rotation sleeve.

4. The system of claim 1, further comprising a plurality of rotation sleeves disposed immediately adjacent one another in series along a length of the valve housing.

5. The system of claim 4, further comprising a plurality of shifters comprising lugs for engaging one or more of the plurality of rotation sleeves.

6. The system of claim 1, further comprising a stop mechanism disposed along one or more of the corresponding features of the orienting sleeve and of the rotating sleeve to stop the shifter from traveling through the valve housing.

7. The system of claim 1, further comprising a plurality of orienting sleeves disposed at different axial positions along a length of the valve housing.

8. The system of claim 1, further comprising a packer setting device, comprising:

a piston disposed in an atmospheric chamber, wherein movement of the piston sets a packer; and a flowline disposed from the atmospheric chamber on one side of the piston to the port in the valve housing such that, when the port of the rotation sleeve aligns with the port in the valve housing, a pressure difference in the atmospheric chamber pushes the piston to set the packer.

9. The system of claim 1, wherein the valve housing, the orienting sleeve, and the rotation sleeve form a valve, and wherein the shifter selectively opens the valve as a result of bringing the port of the rotation sleeve into alignment with the port of the valve housing.

10. The system of claim 1, wherein one or both of the orienting sleeve and the rotation sleeve comprises multiple ports formed therein and having different relative sizes.

11. A system, comprising:

a shifter for selectively changing a state of a valve of a downhole tool, the shifter comprising a substantially cylindrical body and at least two lugs projecting radially outward from the body in fixed relation to each other and to the body, wherein the lugs are disposed at an axial distance from each other along a length of the body and at a rotational distance from each other along a circumference of the body;

wherein the lugs are receivable into corresponding features of an orienting sleeve and a rotation sleeve of the valve to rotate the rotation sleeve relative to a valve housing of the valve as the shifter travels through the valve.

12. The system of claim 11, wherein the shifter further comprises at least three lugs projecting radially outward from the body in fixed relation to each other and to the body, each of the at least three lugs being disposed at a different axial location from each other along the length of the body.

13. The system of claim 11, wherein the at least two lugs are disposed at a rotational distance of approximately 90 degrees from each other along the circumference.

14. The system of claim 11, wherein the shifter is dissolvable in downhole fluids.

15. A method, comprising:

receiving a shifter into a first end of a valve; and lowering and rotating the shifter relative to the valve, whereby a state of the valve is changed as the shifter passes downward through the valve and exits a second end of the valve opposite the first end, wherein lowering and rotating the shifter relative to the valve comprises:

orienting the shifter with respect to a rotation sleeve of the valve such that a lower engagement feature on the shifter engages a rotation feature of the rotation sleeve;

rotating the shifter with respect to the valve housing and an orientation sleeve via interaction of an upper engagement feature on the shifter with an orientation feature on the orientation sleeve of the valve; and automatically rotating the rotation sleeve relative to a valve housing of the valve as the shifter rotates based on the interaction of the upper engagement feature with the orientation feature.

16. The method of claim 15, wherein rotating the rotation sleeve of the valve relative to the valve housing changes the state of the valve as a result of a change in alignment between a port formed in the valve housing and a port formed in the rotation sleeve.

17. The method of claim 15, further comprising dissolving the shifter in a downhole fluid after changing the state of the valve.

18. The method of claim 15, further comprising setting a packer by changing the state of the valve.

19. The method of claim 15, wherein the shifter is an untethered shifter that moves through the valve without any direct physical or mechanical connection between the shifter and an upstream or downstream device.

20. The method of claim 15, further comprising receiving the shifter through multiple valves disposed in series along a length of a tool string, and changing a state of more than one of the multiple valves at the same time via the shifter.

* * * * *